US010832641B2

(12) United States Patent
Chisholm

(10) Patent No.: US 10,832,641 B2
(45) Date of Patent: Nov. 10, 2020

(54) HUMIDITY CONTROLLED MUSICAL INSTRUMENT REED CAP

(71) Applicant: Chisholm & Sons LLC, Seattle, WA (US)

(72) Inventor: Jori Chisholm, Seattle, WA (US)

(73) Assignee: Chisholm & Sons LLC, Seattle, WA (US)

( * ) Notice: Subject to any disclaimer, the term of this patent is extended or adjusted under 35 U.S.C. 154(b) by 136 days.

(21) Appl. No.: 16/000,073

(22) Filed: Jun. 5, 2018

(65) Prior Publication Data

US 2018/0357986 A1 Dec. 13, 2018

Related U.S. Application Data

(60) Provisional application No. 62/516,562, filed on Jun. 7, 2017.

(51) Int. Cl.

| | |
|---|---|
| ***G10D 9/02*** | (2020.01) |
| ***G10D 9/035*** | (2020.01) |
| ***B65D 81/22*** | (2006.01) |
| ***B65D 59/06*** | (2006.01) |
| ***G10G 7/00*** | (2006.01) |

(52) U.S. Cl.

CPC ..... *G10D 9/035* (2020.02); *B65D 59/06* (2013.01); *B65D 81/22* (2013.01); *G10G 7/00* (2013.01)

(58) Field of Classification Search

CPC ..... G10D 9/023; B65D 59/06; B65D 81/22; G10G 7/00

USPC ..... 84/383 A

See application file for complete search history.

(56) References Cited

U.S. PATENT DOCUMENTS

| | | | |
|---|---|---|---|
| 3,407,700 | A | 10/1968 | Ralph |
| 3,719,033 | A | 3/1973 | Den |
| 3,721,152 | A | 3/1973 | Von |
| 4,572,051 | A | 2/1986 | Laskin |
| 4,649,793 | A | 3/1987 | Blackshear et al. |
| 4,674,630 | A | 6/1987 | Kirck |
| 5,219,075 | A | 6/1993 | White |
| 5,936,178 | A | 8/1999 | Saari |
| 6,209,717 | B1 | 4/2001 | Flynn |

(Continued)

FOREIGN PATENT DOCUMENTS

| | | |
|---|---|---|
| ES | 1062557 | 10/2006 |
| ES | 1195563 U | 10/2017 |

(Continued)

*Primary Examiner* — Jianchun Qin

(74) *Attorney, Agent, or Firm* — Richard Batt

(57) ABSTRACT

A woodwind reed storage and maintenance device conveniently fits directly onto the reed bearing end of a musical instrument. The storage and maintenance device includes a reed storage space, humidity control device space, and a humidity gauge. The storage and maintenance device is used to maintain a reed while still located on the musical instrument at a specifically-chosen constant humidity level for optimal performing condition and maximum reed life. The storage and maintenance device protects the reed from physical damage and from damage due to changing humidity levels in the ambient surroundings. The storage and maintenance device accurately measures and displays temperature and humidity information corresponding to the reed storage space inside the device.

23 Claims, 3 Drawing Sheets

(56) References Cited

U.S. PATENT DOCUMENTS

| | | | | |
|---|---|---|---|---|
| 6,620,992 | B1 * | 9/2003 | Kinnaird | G10D 9/023 206/314 |
| 7,665,601 | B2 * | 2/2010 | Portier | B65D 79/02 206/204 |
| 8,087,645 | B2 | 1/2012 | Hepple | |
| 8,748,723 | B1 | 6/2014 | Egberg et al. | |
| 2007/0221039 | A1 | 9/2007 | Quaile | |
| 2010/0012739 | A1 * | 1/2010 | Hoeth | G10G 7/00 236/44 C |

FOREIGN PATENT DOCUMENTS

| | | | |
|---|---|---|---|
| WO | 1993008429 | A1 | 4/1993 |
| WO | 1993015499 | A1 | 8/1993 |

* cited by examiner

HUMIDITY CONTROLLED MUSICAL INSTRUMENT REED CAP

CROSS-REFERENCE TO RELATED APPLICATIONS

This application claims priority to provisional application No. 62/516,562, filed Jun. 7, 2017, entitled "Musical Instrument Reed Storage and Maintenance Device with Humidity Control and Digital Hygrometer and Thermometer" and to GB Application No. GB1711311.9, filed Jul. 13, 2017, entitled "Musical Instrument Reed Storage and Maintenance Device with Humidity Control and Digital Hygrometer and Thermometer".

BACKGROUND OF THE INVENTION

The present invention generally relates to musical instrument maintenance devices and more particularly, to a storage and maintenance cap for a musical instrument bearing a reed.

Natural cane reeds for woodwind instruments absorb moisture from the ambient air and also from player's breath while being played. During the initial time of playing, the reed will typically absorb moisture, which will affect how the reed vibrates. The reed's pitch, tuning, volume, and tonal quality (i.e., timbre) will change until a stable equilibrium of humidity and temperature has been reached. The length of time it takes to reach this equilibrium depends largely upon the moisture content present in the reed prior to playing. If the reed is stored in a container without a controlled humidity level, the reed will be subject to changes in humidity caused by daily fluctuations in temperature, local weather, indoor heating or cooling systems, or a new travel destination. Any changes in the ambient humidity and/or temperature will change the moisture content in the reed and will adversely affect the stability and reliability of the performance of the reed.

Most woodwind players blow directly onto the reed (e.g., clarinet, oboe, saxophone) so the reed's stable playing humidity level will approach 100%. Some woodwind players blow indirectly onto the reed, for example the Highland bagpipes, where the musician blows into a bag which is squeezed with the arm to expel air out through the reed. Highland bagpipers can control the amount of moisture that gets to the reed by utilizing any combination of physical moisture control systems to physically trap and collect or block the path of liquid water (e.g. tubes or bottles), or desiccant-based moisture filter systems that remove the water vapor from the breath before it gets to the reed. As a result, the stable humidity level for bagpipe reeds can vary depending on the ambient conditions and the player's use of these physical moisture control systems or moisture filter systems. Furthermore, some bagpipes use a bellows to supply air to the bag. Bellows-driven bagpipes use ambient air so the reeds are not subject to moisture from a player's breath. As a result, bellows-driven bagpipe reeds are subject to change based on the conditions of surrounding environment.

Players of woodwind instruments play in a variety of conditions (e.g. indoors and outdoors). Climates around the world range from those with little variability (e.g. Honolulu) to others with drastic seasonal changes (e.g. Buffalo). Outdoor conditions might range from low humidity (e.g. Las Vegas 30% r.h.) to high humidity (e.g. Edinburgh 89% r.h.). Furthermore, temperature and humidity can vary widely throughout the day in a single location (e.g. relative humidity can drop as much as 50% or more from early morning to peak sunshine in mid-afternoon). Depending on the environmental conditions, woodwind players may prefer to moisten their reed prior to playing by either by dipping the reed in water or applying saliva to the reed with their mouth or tongue, while others prefer to keep their reeds drier. Experienced woodwind players may change how much they moisten a reed to compensate for the environmental conditions, e.g., when playing in hot and dry conditions, they will moisten the reed prior to playing and/or they will avoid use of any physical moisture control systems or moisture filter systems while playing.

Conversely, in cold, wet or humid environmental conditions, players may limit or eliminate any moisture applied to the reed prior to playing and/or they may utilize any combination of physical moisture control systems or moisture filter systems to reduce, as much as possible, additional moisture getting to the reeds from their breath. Furthermore, woodwind instrument players who travel to new locations will need to compensate not only for the effects of the environmental conditions of the new location on the reed, but also for the very low humidity conditions on commercial airline passenger cabins (can be lower than 20% r.h.)

When the reed absorbs moisture either from playing or from the environment, the cane swells and its physical properties change. Absorbed moisture will change the stiffness of the cane blades of the reed and make the cane blades of the reed heavier. These changes in stiffness and weight of the can blade will change the musical frequency (e.g. pitch) of the notes that are played and will change the reed's overall blowing strength.

Cane reeds are typically thinner towards the vibrating tip and thicker towards the base of the reed where it attaches to the instrument. The thinner parts of the reed will absorb moisture faster and will absorb a greater amount of moisture than the thicker parts of the reed. In addition, cane is a natural material of non-uniform density. Thus, the parts of the reed with cane of lower density will absorb moisture faster and will absorb a greater amount of moisture than the parts of the reed with cane of higher density. Conversely, when the reed dries out through evaporation, the thinner parts of the reed will dry out faster and will dry out to a greater degree than the thicker parts of the reed. Likewise, parts of the reed with cane of lower density will dry out faster and to a greater degree than the parts of the reed with cane of higher density.

The uneven rates and amounts of moisture absorption and drying of the reed lead to uneven swelling and shrinking of the cane and can warp or crack the reed. Warping will often permanently damage reed and leads to undesirable musical characteristics including: altered blowing strength of the reed, reduced pitch stability of individual notes or the entire ranges of notes, diminished tonal characteristics (thinness or harshness), or unwanted acoustic effects (squeaks or squeals). Repeated cycles of uneven swelling from moisture and uneven shrinking from drying out can have a cumulative damaging effect on the cane, can deteriorate the reed's musical performance characteristics, and can make the reed unplayable. The magnitude of swelling and shrinking of the reed and, thus, the potential for damage, depends largely on the difference between the reed's moisture content prior to playing and the reed's moisture content during playing. A greater difference in the moisture content of the reed prior to playing and during playing will lead to greater swelling during playing. Likewise, a reed stored at a low humidity level will dry out faster and to a greater degree, and will be at increased risk for warping and cracking and damage.

Furthermore, double reeds (e.g. bagpipe, bassoon, oboe) are constructed from two blades of cane wrapped with thread around a metal staple (i.e., tube). The precise tension of the wrapped thread is important for consistent, high-quality reed performance. The repeated cycle of swelling and shrinking of the cane can damage the overall construction of the reed by altering the tension of the thread wrapping. The tension of the thread wrapping is tighter when the cane reed blades are moister and swollen. Conversely, the tension of the thread wrapping is looser when the cane reed blades are dry and have shrunken. This fluctuation in the tension of the reed's thread wrapping caused by fluctuation of the moisture content in the cane blades reduces the reliability and consistency of the reed's performance. The repeating cycle of swelling and shrinking damages the thread wrapping on the reed, and shortens the reed's useful lifespan.

When selecting and preparing a new, unplayed reed for performance, woodwind players will typically play the reed for a break-in period lasting a few days to several weeks, to make any needed adjustments to the reed and to ensure the reed will perform optimally. A new, unplayed reed level requires a longer break-in period. Furthermore, every time the reed is played, it will require a longer playing time to reach an equilibrium of moisture content within the reed, taking longer to reach a consistent and stable pitch, tuning, volume, and tonal quality.

Any cane woodwind reed may thus be subject to a cycle of regular fluctuations in humidity which will lead to variations in the moisture content of the reed. These variations in the reed's moisture content, caused by even small changes in the ambient humidity level, diminish the reed's musical performance characteristics and damage the reed, reducing its useful playable lifespan.

The prior art has attempted to address this problem. Currently, reed storage devices generally fall into these categories: (1) containers that require the reed to be removed from the playing end of the instrument and placed into a container such as box, case, tube, or sleeve; (2) caps that are placed over the reed on the playing end of the instrument; and (3) moistening devices that consist of devices in (1) or (2) above with the added feature of some sort of device to add moisture to the reeds while they are being stored. These devices typically require water to be added to a chamber containing an absorbent material (e.g., sponge, clay, or super-absorbing polymer) which slowly releases moisture over time.

A number of patents attempt to address some of the above described challenges in storing and maintaining reeds. U.S. Pat. No. 6,620,992 to Kinnaird, for example, describes a storage device for musical reeds including a container comprising a reed chamber adapted for holding a reed, and a humidity controlling chamber arranged such that air is exchanged substantially freely between the reed chamber and the humidity controlling chamber. A humidity controlling mixture, comprising a salt, a superabsorber, and water, is contained within the humidity controlling chamber. The amount of water is such that a portion of the salt remains undissolved, and such that water saturated with the salt is absorbed by the superabsorber. The apparatus can be adapted to attach to an instrument so that the reed can be stored in a somewhat humidity-controlled environment while in its playing position on the instrument.

U.S. Pat. No. 4,674,630 to Kirck describes a portable, self-enclosed reed case that includes a main enclosure that is divided by an aerated partition into a reed chamber and a hygrostat chamber, a reed slide adapted to receive and releasably secure a plurality of reeds, and a hygrostat container adapted to receive a hygrostat that maintains a constant relative humidity. The reed slide and hygrostat container, when assembled into the reed chamber and hygrostat chamber, respectively, form an interaction unit that maintains the reeds in a "ready-to-play" state.

U.S. Pat. No. 5,936,178 to Saari describes a humidity control device for use in maintaining a desired humidity. The Saari device includes a protective case, a water vapor permeable pouch and a thickened saturated solution, the solution having a suitable humidity control point.

Still other moistening devices consist of sealed containers which keep the reeds in a completely saturated environment (100% r.h.).

Notwithstanding the above, it has been appreciated by the inventor that there is still a need for an improved device for the storage and maintenance of woodwind reeds. The prior art devices generally seek to keep a pre-set humidity, often saturation, or inhibit changes which may inhibit ageing but do not allow the user to specifically-choose or control or monitor the humidity level. Sealed containers at 100% humidity can result in oversaturated reeds with a muffled, flat, or otherwise poor tonal characteristics. Likewise, saturated conditions can lead to the growth of bacteria and mold on the reeds. Some of these devices can be used with alcohol in the form of vodka (40% ethanol) or mouthwash (e.g., Listerine®, 28% ethanol). However, while alcohol will kill most forms of bacteria and visible mold filaments, alcohol will not effectively kill mold spores. In addition, other ingredients in mouthwash solutions (e.g. menthol, eucalyptol, thymol) can lead to a buildup of oily or sticky residues on the reed over time and can lead to undesirable musical performance effects (e.g. loss of efficiency, squeals, unbalanced tuning of notes). In addition, the total saturation level of these devices is not ideal, as some woodwind players may prefer to specifically choose a humidity level other than 100% r.h. to best suit their desired performance needs.

The inventor has appreciated that there is still a need for a device which allows the reed to be stored at a specifically-chosen humidity level to eliminate the effect on the reed of fluctuations in ambient humidity, for a device with the flexibility to choose from a variety of humidity control device options by adding or removing moisture as desired by the player, and for precise measurement and clear display of the humidity level and temperature within the device to verify that the humidity control function is operating properly in order to maintain the desired reliable and consistent performance from the reed and to extend its playable lifespan.

SUMMARY OF THE INVENTION

A device stores and maintains woodwind reeds at a specifically-chosen controlled humidity level for optimal reed performance and maximum reed lifespan.

In embodiments, a reed storage and maintenance device is adapted to engage and enclose the reed-bearing end of the musical instrument. The reed storage and maintenance device is attached to the musical instrument so that the reed can be left in place on the instrument while being stored.

In embodiments, the reed storage and maintenance device is in the form of an instrument reed cap. The instrument reed cap comprises a plurality of areas including (a) a reed storage area for accepting the end of the musical instrument bearing the reed, (b) a humidity control area for holding a humidity control material, and (c) a gauge to provide water, humidity, temperature or other useful information regarding the reed storage area.

In embodiments, the reed storage area is a cylindrical space defined by a hollow tube. The reed storage area is sized to contain the reed and end of the musical instrument while the reed is still fastened to the instrument. In a preferred embodiment, the instrument reed cap has a necked region of smaller diameter than the reed storage area that engages the outer circumference of the musical instrument. In an embodiment, a fastener is provided to further affix the cap to the end of instrument. Consequently, the reed and end of the instrument are surrounded by the cap.

Embodiments of the present invention also provide a humidity control space or holder to keep the humidity control agent in place and to prevent it from coming into physical contact with the reed while being stored. In a preferred embodiment, the humidity control space is an annular zone between an outer member and an inner tubular member. In another embodiment, the humidity control agent is held by a holder such as a resilient arm, clip or clamp, thereby holding the agent in place.

In embodiments, the humidity control agent includes a water-absorbing material such as a sponge, a desiccant or drying-agent such as silica gel, or a two-way humidity control pouch. In embodiments the controlled humidity level is neither substantial saturation nor substantial dryness. In embodiments the device is arranged to control and allow monitoring of a humidity level in the range of 30% to 85%. In systems and methods embodying the invention, there may be a storage device for the reed and a user may select one of a selection of humidity control pouches respectively configured to maintain a plurality of humidity levels (preferably at least three alternative selections) between 30% and 85% and insert the pouch into a corresponding portion of the storage device. In embodiments, the humidity levels are controlled to a specific level such as, for example: 32%, 49%, 58%, 62%, 65%, 68%, 72%, 75%, and 84%.

In embodiments, the reed storage and maintenance device provides the user the flexibility to specifically choose the precise desired humidity level for optimal reed performance. The user can increase or decrease the desired humidity level simply by removing the humidity control agent and replacing it with a different one to achieve a new desired humidity level. The flexibility of the present invention to readily accept a variety of humidity control agents that can be easily and quickly changed allows the user to adjust the humidity level within the device as needed to compensate for changes in ambient playing conditions and for desired musical performance characteristics.

In embodiments, the gauge monitors the contents in the cap and shows current water information. Though the gauge may be analog, in a preferred embodiment, the gauge is digital such as a digital hygrometer and thermometer that accurately measures and displays the humidity level and temperature within the device because a small fluctuation in the humidity level within the reed can adversely affect the reed's performance, damage the reed, and shorten its lifespan. The monitoring and indication of water content in the device is a clear advantage and improvement over the previous devices.

Still other descriptions, objects and advantages of the present invention will become apparent from the detailed description to follow, together with the accompanying drawings.

DETAILED DESCRIPTION OF THE INVENTION

Before the present invention is described in detail, it is to be understood that this invention is not limited to particular variations set forth herein as various changes or modifications may be made to the invention described and equivalents may be substituted without departing from the spirit and scope of the invention. As will be apparent to those of skill in the art upon reading this disclosure, each of the individual embodiments described and illustrated herein has discrete components and features which may be readily separated from or combined with the features of any of the other several embodiments without departing from the scope or spirit of the present invention. In addition, many modifications may be made to adapt a particular situation, material, composition of matter, process, process act(s) or step(s) to the objective(s), spirit or scope of the present invention. All such modifications are intended to be within the scope of the claims made herein.

Methods recited herein may be carried out in any order of the recited events which is logically possible, as well as the recited order of events. Furthermore, where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

All existing subject matter mentioned herein (e.g., publications, patents, patent applications and hardware) is incorporated by reference herein in its entirety except insofar as the subject matter may conflict with that of the present invention (in which case what is present herein shall prevail).

Reference to a singular item, includes the possibility that there are plural of the same items present. More specifically, as used herein and in the appended claims, the singular forms "a," "an," "said" and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

Overview

The subject invention is a device adapted to store and maintain the reed of a woodwind instrument while the reed is still on the playing end of the woodwind instrument. Examples of woodwind instruments bearing reeds include the bagpipes, oboe, clarinet, bassoon, saxophone, English horn and any other woodwind type or reed bearing instrument. The invention is applicable to protecting single reed or multi-reed instruments.

Figure 1:
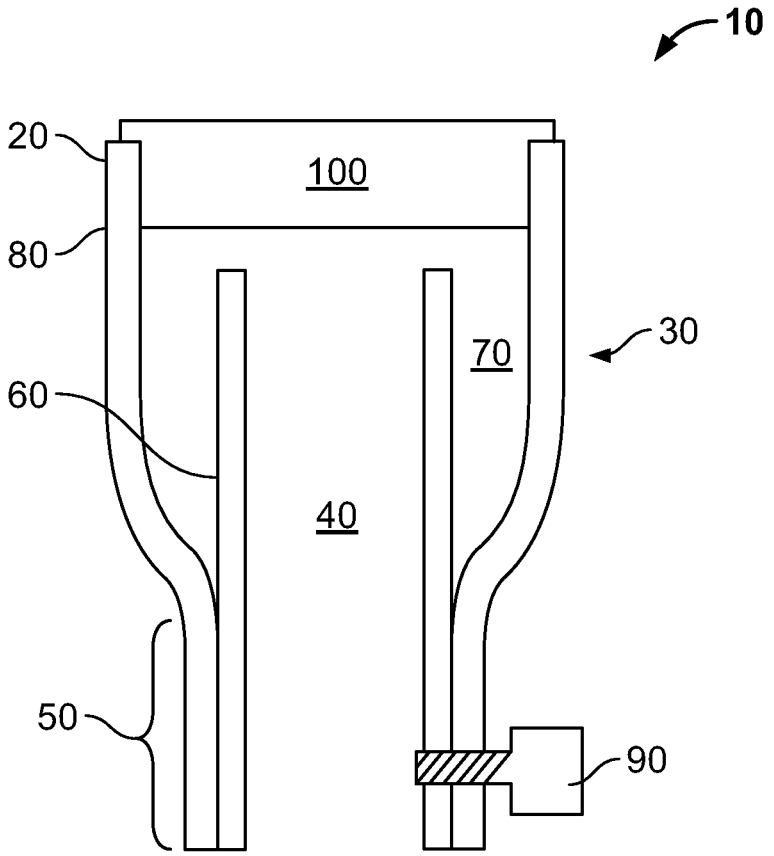
FIG. 1 is an illustrative representation showing a cross sectional view of the reed storage and maintenance device in accordance with an embodiment of the present invention.

Now with reference to FIG. 1, a cross sectional view of a reed storage and maintenance device 10 is shown in accordance with an embodiment of the present invention. The depiction shown in FIG. 1 is intended to provide an easy to understand view of various exemplary components but the presence of each of the components is not meant to be limiting except where such components are specifically recited in the appended claims.

The reed storage and maintenance device 10 shown in FIG. 1 includes a body 30 with upper and lower ends 20, 50 respectively, a reed storage area 40, and a humidity control space 70 defined between a humidity control device holder 60 and the wall 80 of the body 30.

Humidity Control Device Holder

The humidity control device holder 60 is shown having a cylindrical or tube-like shape. The holder 60 is shown in a coaxial arrangement within the body 30, defining a humidity control space 70 between the humidity control device holder 60 and the outer wall 80 of the device's body. The annular shaped space 70 keeps the humidity control device (not shown) in place to prevent physical contact with the reed.

The humidity control device holder 60 is shown attaching to the lower end 50 of outer housing/body 30. The holder may be attached to the body using a number of techniques such as, for example, press fit, adhesives, fuse heat bond, or fasteners. The cylinder can have a threaded hole to attach to the turning lock screw 90 so that manipulation of the screw urges the body against the instrument, discussed further herein.

The humidity control device holder 60 may be made of Delrin® acetal homopolymer resin or could be made from a variety of materials, such as plastic, metal, wood or carbon fiber. An exemplary wall thickness of the cylindrical humidity control device holder 60 is approximately 3 mm.

Reed Storage Area

Inside of the cylinder 60 is a reed storage area 40. The inside diameter of the cylindrical humidity control device holder 60 is approximately 22 mm, to accommodate standard bagpipe chanter sizes up to a maximum of 22 mm. Bagpipe chanters of smaller size can be accommodated by adjustment of the turning lock screw 90.

Additionally, although the holder 60 is shown as a cylinder or tube, and the humidity control space 70 is shown as annular, the holder and space may vary widely. In other embodiments, the humidity control space is above or below the reed storage chamber 40. Alternatively, the holder may be in the form of a clamp, clip, arm, or another resilient member to secure a humidity control agent or device in place.

FIG. 1 also shows that humidity control space 70 is in fluid communication with the reed storage area 40 so that when the humidity control agent (not shown) is present within the chamber 70, the humidity level of the reed storage chamber is controlled. Although an empty pathway is shown, water vapor permeable dividers may separate or define the different spaces and chambers. Dividers may be rigid or soft, having holes or perforations serving to make the dividers vapor, gas or fluid permeable.

Humidity Control Device

As described above, a humidity control device is placed within the chamber 70 to control humidity. The type and construction of the humidity control device may vary widely. The humidity control device may be a self-contained or integrated assembly, or it may be a material or substance whether raw or processed. Examples of humidity control agents include a water-absorbing material such as a sponge, a desiccant or drying-agent such as silica gel, or a two-way humidity control pouch or pieces or portions thereof. An example of a humidity controlled pouch is the Boveda® 75% 8 GRAM, made by Boveda Inc. of Minnetonka, Minn., United States. In embodiments, the humidity levels are controlled to a specific level such as, for example: 32%, 49%, 58%, 62%, 65%, 68%, 72%, 75%, and 84%. See also U.S. Pat. No. 5,936,178, describing types of humidity control agents for controlling humidity.

Another example of a humidity control agent could be cedar wood or a portion thereof that could hold water or another solution. Examples of types of solutions include water, water in combination with alcohol or another humidifying and/or sterilizing solution.

FIG. 1 also shows an adjustable fastener 90 (such as a turning lock screw) extending through the side wall of the lower portion or neck 50. When the device 10 is placed on the end of an instrument (not shown), and the reed is enclosed within the reed storage area 40, the fastener 90 is manipulated, allowing the user to clamp the device 10 to the end of instrument to provide a snug fit.

Gauge

The reed maintenance and storage device 10 shown in FIG. 1 also has a gauge 100 located in the upper or second end 20. The gauge 100 monitors and indicates current characteristics within the reed storage area 40. Examples of characteristics monitored include temperature and humidity. Examples of information that may be indicated by the gauge include humidity levels, temperature levels, and system pass or failure modes. Information may be indicated via use of symbols, numbers, indicia, colors, audio, and alarms. Providing a measure of both temperature and humidity, either simultaneously or selectably or in combined form is advantageous.

Additionally, the gauge may be digital or analog based. In a particular embodiment, the gauge 100 is a round digital hygrometer and thermometer. An example of a digital hygrometer/thermometer is the YOUKONG TPM-50 Digital Round Thermometer Hygrometer, manufactured by Shenzen U-Control Electric Co, Ltd. (Shenzen City, China). The digital hygrometer/thermometer can be powered by a single AG13 button-type alkaline battery. However, other digital hygrometer/thermometers may be used. Additionally, the gauge may have additional functions, features, shapes, and dimensions.

Construction Manufacture of the Device

The shape and material of the components of the novel cap 10 may vary. In a particular embodiment of the present invention, the outer housing/body 30 is made of silicone with a 4 mm wall thickness. Preferably, the housing 30 is a handheld size (e.g., about 85 mm in height) allowing enough space for the top of the instrument (e.g., a bagpipe chanter) holding the reed to be inserted in the reed storage area 40. The somewhat elastic silicone material allows for an airtight fit to both the digital hygrometer/thermometer 100 and the lower end 20 of the rigid plastic cylindrical humidity control device holder 60. The outer housing/body 30 could alternatively be made of plastic, rubber, metal or other materials. In embodiments, the inner diameter of the wider, upper end 20 of the housing is 40 mm, which gives a tight fit to the digital hygrometer/thermometer 100 and also allows the user's specifically chosen humidity control device to be inserted and held in place in the space 70 between the humidity control device holder 60 and the outer housing/body 30. In embodiments, the gauge is round and has an outer diameter of 40 mm and a height of 15 mm.

Use of the Novel Device

The device may be conveniently used after playing the musical instrument to maintain and store the reed in a desired condition.

Initially, in order to play the bagpipes, a reed is inserted into the top end of the bagpipe chanter. The end of the bagpipe chanter is inserted into the bag via the bagpipe chanter stock, thus enclosing the reed within the instrument. The player inflates the bag by blowing into a blowpipe attached to the bag (or, in the case of a bellows operated bagpipe, by squeezing the bellows) and squeezes the bag with the arm to expel air through the reed. The reed naturally absorbs some moisture during playing, and exposure to the environment. After playing, the end of the bagpipe chanter holding the reed is removed from the bag.

Figure 2A:
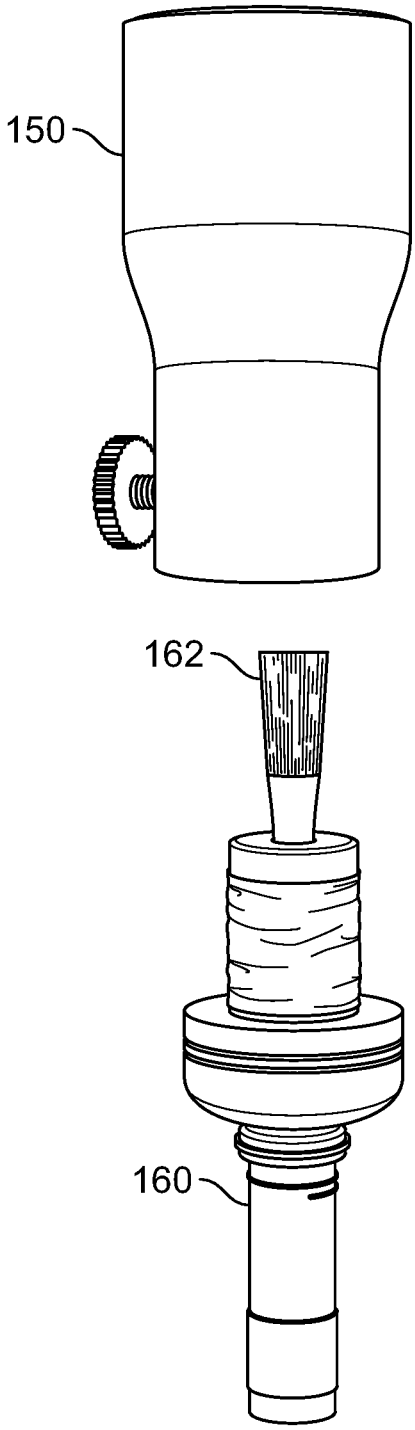
FIGS. 2A, 2B, are illustrative representations showing placement of a reed storage and maintenance device onto a chanter of a bagpipe in accordance with an embodiment of the present invention.
Figure 2B:
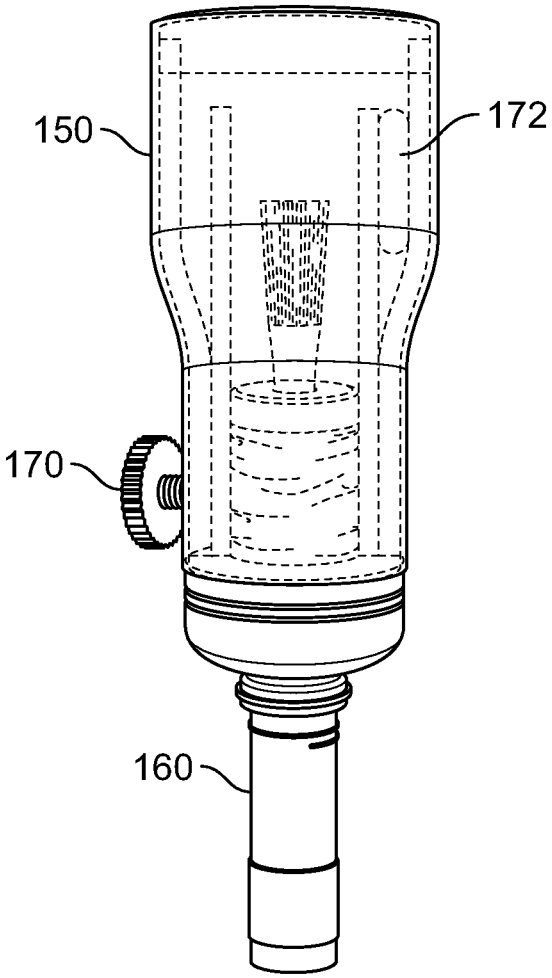

With reference to FIGS. 2A, 2B, to store and maintain the reed in accordance with embodiments of the present invention, the end of the bagpipe chanter 160 holding the reed 162 is inserted into the reed storage area of the device 150. The device is securely attached to the top of the bagpipe chanter by the means of a turning lock screw 170 which when tightened presses the chanter 160 against the opposite inside wall side of the device 150 for a secure fit. Attachment methods other than the tunable lock screw could be used such as but not limited to a twisting compression lock nut or locking lever found on adjustable length walking canes or camera tripod legs. Additionally, the dimensions of the open end of the device could be customized to fit snugly to end of the bagpipe chanter thus eliminating the need of a tightening device or fastener.

Once installed, the humidity control material 172 maintains the humidity to a desired level. In this manner, the device 150 stores and maintains the reed on the instrument.

Figure 3:
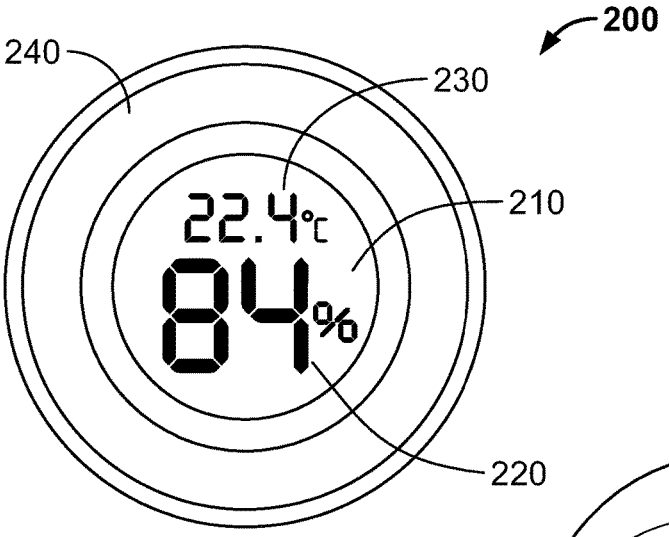
FIG. 3 is an illustrative representation showing a top-end view of the reed storage and maintenance device in accordance with an embodiment of the present invention.

FIG. 3 is an illustrative representation showing a top-end view of the reed storage and maintenance device 200 in accordance with an embodiment of the present invention. This depiction provides a view of the gauge screen and different readings or information shown on the top of the device. The user can verify the device is working properly. This is an important improvement over conventional solutions in which a user had to trust that the moisture content was correct. Even opening the device up to visually check on the moisture control agent would only show whether the agent was completely dried up. Consequently, the user would not be able to determine the humidity level with any precision and consistency. Moreover the gauge as described herein enables a user to control a humidity level to a desired target level, for example based on intended next playing time or location. In the embodiment shown in FIG. 3, the gauge is a battery-powered digital hygrometer and thermometer which measures and displays on a liquid-crystal display 210 the relative humidity level 220 and temperature 230 in Celsius or Fahrenheit inside of the reed storage and maintenance device. The digital hygrometer/thermometer includes a housing 240 which seals the top of the device 200, keeps the moisture control device in place, and protects the reed from outside physical damage. The digital hygrometer/thermometer allows the player to visually determine the relative humidity level and temperature inside the device. The digital hygrometer/thermometer can be removed to access the humidity control device, to visually inspect the reed, to replace the battery, or to optionally allow ambient air to get to the reed while still offering substantial protection.

Figure 4:
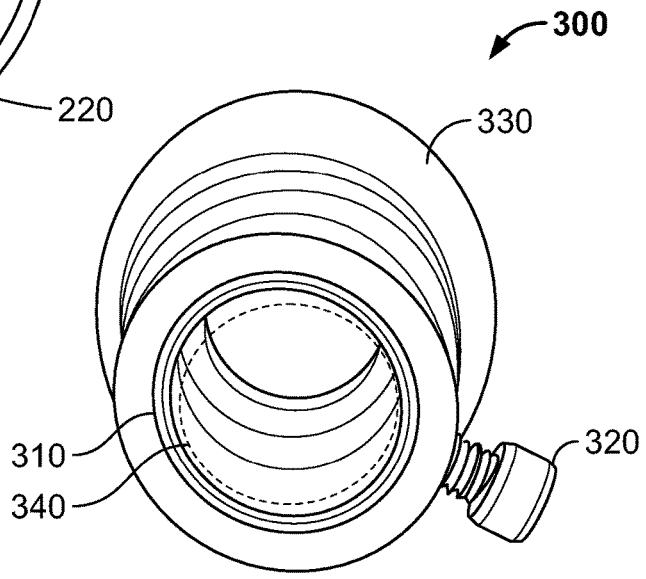
FIG. 4 is an illustrative representation showing a bottom perspective view of the reed storage and maintenance device in accordance with an embodiment of the present invention.

FIG. 4 is an illustrative representation showing a bottom perspective view of the reed storage and maintenance device 300 in accordance with an embodiment of the present invention. This depiction shows the humidity control device holder 310, turning lock screw 320, housing/body of the device 330, and the reed storage area 340 indicated by broken lines.

Figure 5:
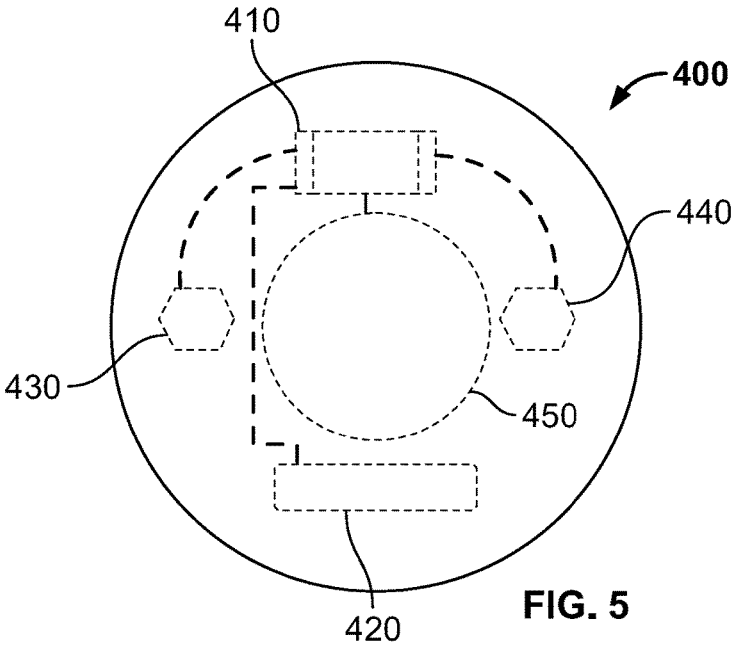
FIG. 5 is an illustrative representation showing a top-end view of the reed storage and maintenance device with internal electronic components in accordance with an embodiment of the present invention.

FIG. 5 is an illustrative representation showing a top view of the reed storage and maintenance device with electronic components shown in broken lines in accordance with an embodiment of the present invention. This depiction provides a diagram of the electronic components stored inside of the gauge 400. Particularly, a circuit including a processor or motherboard 410 communicates with the different components inside of the gauge 400. The motherboard 410 is powered by a removable battery 420. The motherboard receives information from the digital hygrometer 430 and thermometer 440, processes it and sends the signal to be displayed on the Liquid Crystal Display 450. Additionally, electronic components could be added for additional measurements, including, e.g., time and date, minimum and maximum temperature, minimum and maximum humidity, and to wirelessly transmit data to a connected computer or device.

Alternative Embodiments

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by this application.

For example, although preferred materials for elements of the device have been described above, the device is not intended to be limited to those specific materials. Wood, plastics, rubber, foam, metal alloys, aluminum, carbon fiber, fiberglass, 3D printed composites, and other materials may comprise some or all of the elements of the components in various embodiments of the present invention.

Additionally, the configuration of the humidity control holder may vary widely. Instead of a chamber or space, the holder may be in the form of an arm, clip, hole, shelf, chamber, pin, etc.

Additionally, the configuration of the gauge may vary widely. Indeed, other types of gauges whether analog or digital may be incorporated into the present invention. The gauge may indicate a wide range of types of information including, e.g., the humidity, the presence of water, a specific level or degree, as well as dummy-type gauges or lights which indicate whether there is a malfunction, needs batteries (e.g., "BATTS"), or "Needs Attention".

Additionally, the humidity control device may vary widely and comprise a self-enclosed water vapor permeable pouch or raw desiccant materials which absorb water or moisture from the air. In an alternative embodiment, the humidity control material and liquid water are contained in the humidity control sections to control humidity to a desired or target level.

Additionally, the claimed invention may operate with a variety of types of musical instruments. The lower neck (alone or in combination with fasteners) can be designed to engage a wide range of musical instruments including without limitation the bagpipe, saxophone, clarinet, saxophone, bassoon, oboe, etc.

The invention claimed is:

1. An instrument reed cap for protecting a reed on a first end of the instrument, the instrument reed cap comprising:

a body comprising an opening and a reed storage cavity for receiving and enclosing the first end of the instrument carrying the reed; wherein the body further comprises an outer wall and an inner wall defining an annular shaped humidity control space within the body; and wherein the inner wall is formed by the exterior of a cylindrical tube member, and the reed storage cavity is defined by the inside of the cylindrical tube member;

a water absorbing humidity control material located within the humidity control space;

an empty or open pathway between the humidity control space and the reed storage cavity; and a humidity gauge coupled to the body for monitoring humidity within the cavity.

2. The instrument reed cap of claim 1, wherein the gauge comprises a display.

3. The instrument reed cap of claim 2, wherein the display is a liquid crystal display.

4. The instrument reed cap of claim 2, wherein the gauge is analog.

5. The instrument reed cap of claim 1, wherein the gauge shows a humidity level.

6. The instrument reed cap of claim 1, wherein the gauge indicates whether the humidity level is within a predetermined range.

7. The instrument reed cap of claim 1, wherein the humidity control material is selected from the group consisting of sponge, desiccant, and silica gel.

8. The instrument reed cap of claim 1, wherein the humidity control material is contained within a self-contained device or pouch.

9. The instrument reed cap of claim 1, wherein the humidity control material controls the humidity within the cavity to one pre-selected level from 30-80%.

10. The instrument reed cap of claim 1, wherein the opening is adapted to engage on the outside surface of the first end of the instrument.

11. The instrument reed cap of claim 10, wherein the opening is adapted to engage on the outside surface of the end of a chanter of a bag pipe.

12. The instrument reed cap of claim 1, further comprising a fastener to secure the body to the first end of the instrument.

13. The instrument reed cap of claim 1, further comprising a temperature sensor.

14. The instrument reed cap of claim 13, further comprising a display to show at least one of humidity and temperature information.

15. The instrument reed cap of claim 1, further comprising a wireless communication module to send information to a remote device.

16. A storage and maintenance device for protecting a reed on a first end of an instrument comprising:

a body for receiving and enclosing the first end of the instrument carrying the reed;

the body further comprising a humidity control holder for securing or containing a humidity control material therein;

a housing member that is removable from the body, allowing access to the humidity control holder, humidity control material, and the reed while the first end of the instrument is still enclosed by the body;

a hygrometer for monitoring humidity within the body.

17. The device of claim 16, further comprising the humidity control material to control humidity.

18. The device of claim 17, further comprising a humidity control device, and wherein the humidity control material is contained within the humidity control device.

19. The device of claim 18, wherein the humidity control device is a self-contained pouch.

20. The device of claim 19, wherein the self-contained pouch controls the humidity within the body to one pre-selected level from 30-80%.

21. The device of claim 16, wherein the hygrometer is contained within the housing member, and wherein the housing member removably seals an end of the body.

22. The device of claim 16, further comprising a display to show at least one of humidity and temperature information.

23. The device of claim 22, further comprising a wireless communication module to send information to a remote device.

* * * * *